United States Patent [19]

Fischer

[11] B 3,985,836

[45] Oct. 12, 1976

[54] ALTITUDE COMPENSATED CARBURETOR FLOAT VALVE

[75] Inventor: Earl R. Fischer, Rochester, N.Y.

[73] Assignee: General Motors Corporation, Detroit, Mich.

[22] Filed: Mar. 27, 1975

[21] Appl. No.: 562,462

[44] Published under the second Trial Voluntary Protest Program on January 13, 1976 as document No. B 562,462.

[52] U.S. Cl. ..... 261/39 A; 137/81; 137/426; 137/432; 261/70; 261/73

[51] Int. Cl.[2] ..... F02M 5/06

[58] Field of Search ..... 261/39 A, 70, 73; 137/426, 81, 432

[56] References Cited

UNITED STATES PATENTS

| | | | |
|---|---|---|---|
| 1,103,803 | 7/1914 | Meissner | 137/426 |
| 1,290,883 | 1/1919 | Blanning | 137/426 |
| 1,532,291 | 4/1925 | Woolson | 261/39 A |
| 1,814,804 | 7/1931 | Heftler | 137/432 |
| 2,111,855 | 3/1938 | Groh | 261/39 A |
| 2,619,959 | 12/1952 | Holmes | 137/81 |
| 3,051,193 | 8/1962 | Griffen | 261/70 |

*Primary Examiner*—Tim R. Miles
*Attorney, Agent, or Firm*—Arthur N. Krein

[57] ABSTRACT

The level of fuel in the float bowl of a carburetor is controlled by a semi-spherical inlet valve that is carried by an ambient pressure responsive aneroid-toroidal float assembly in position to coact with a vertically adjustable seat on a fuel inlet whereby the level of fuel in the float bowl is compensated for pressure and altitude variations.

3 Claims, 2 Drawing Figures

ALTITUDE COMPENSATED CARBURETOR FLOAT VALVE

This invention relates to a carburetor for an internal combustion engine and, in particular, to an altitude compensated float controlled valve unit for the fuel inlet of a carburetor.

The fuel level controlled by the float setting in the fuel bowl is an important part of the calibration of a carburetor. If the fuel level in the float bowl is lower than specified for the carburetor, greater than normal air flow will be required through the venturi of the carburetor to lift a given amount of fuel from the float bowl so that the induction mixture to the engine will be lean. The effects of a lower fuel level in the float bowl causes poor performance in the main metering system of the carburetor, resulting in a definite loss of power from the engine. On the other hand, a high fluid level can result in premature main metering delivery and fuel spillage during normal car maneuvering, each of which causes excessive fuel consumption and an over-rich condition.

Accordingly, it is apparent that the float system is perhaps one of the most important systems in the carburetor, as the correct operation of all other systems depends on a correct level of fuel in the float bowl for various conditions under which the engine is required to operate. For example, at altitude, a lower fuel level than normal is required to prevent an over-rich air-fuel mixture from being supplied to the engine.

It is therefore a primary object of this invention to provide an improved float controlled valve unit for the fuel inlet of a carburetor system whereby the fuel level is altitude compensated.

Another object of this invention is to provide an improved float controlled valve unit providing altitude compensation and part throttle adjustment of the fuel level in the float bowl of a carburetor.

These and other objects of the invention are obtained by means of a valve unit including a semi-spherical inlet valve carried by an ambient pressure responsive aneroidtoroidal float assembly in the fuel bowl of a carburetor, the inlet valve coacting with a vertically adjustable fuel inlet seat whereby the fuel level can be compensated for pressure variations.

Figure 1:
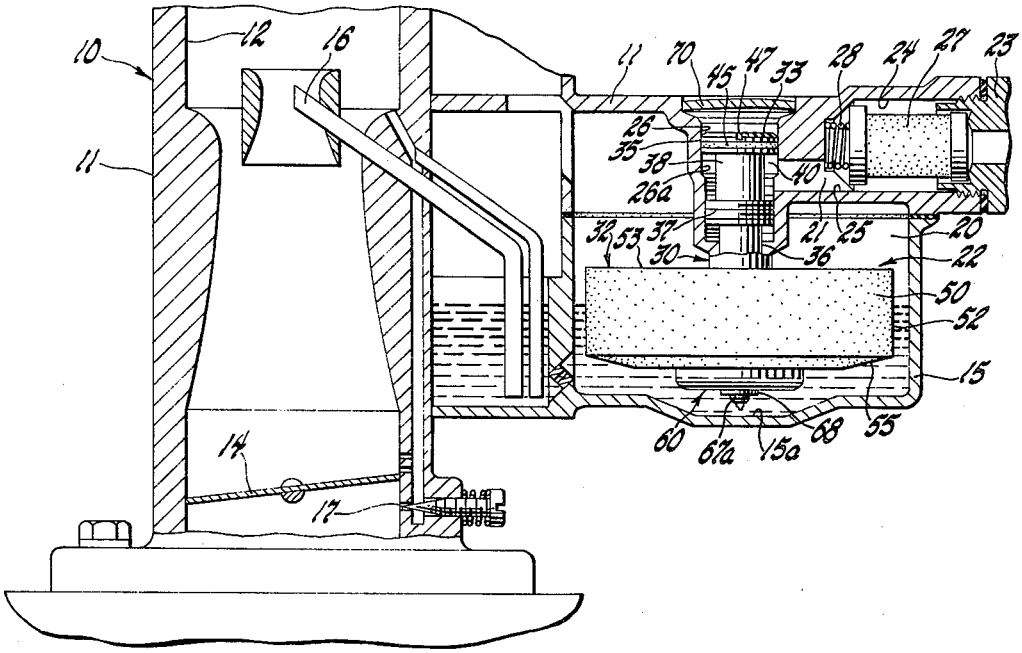
Figure 2:
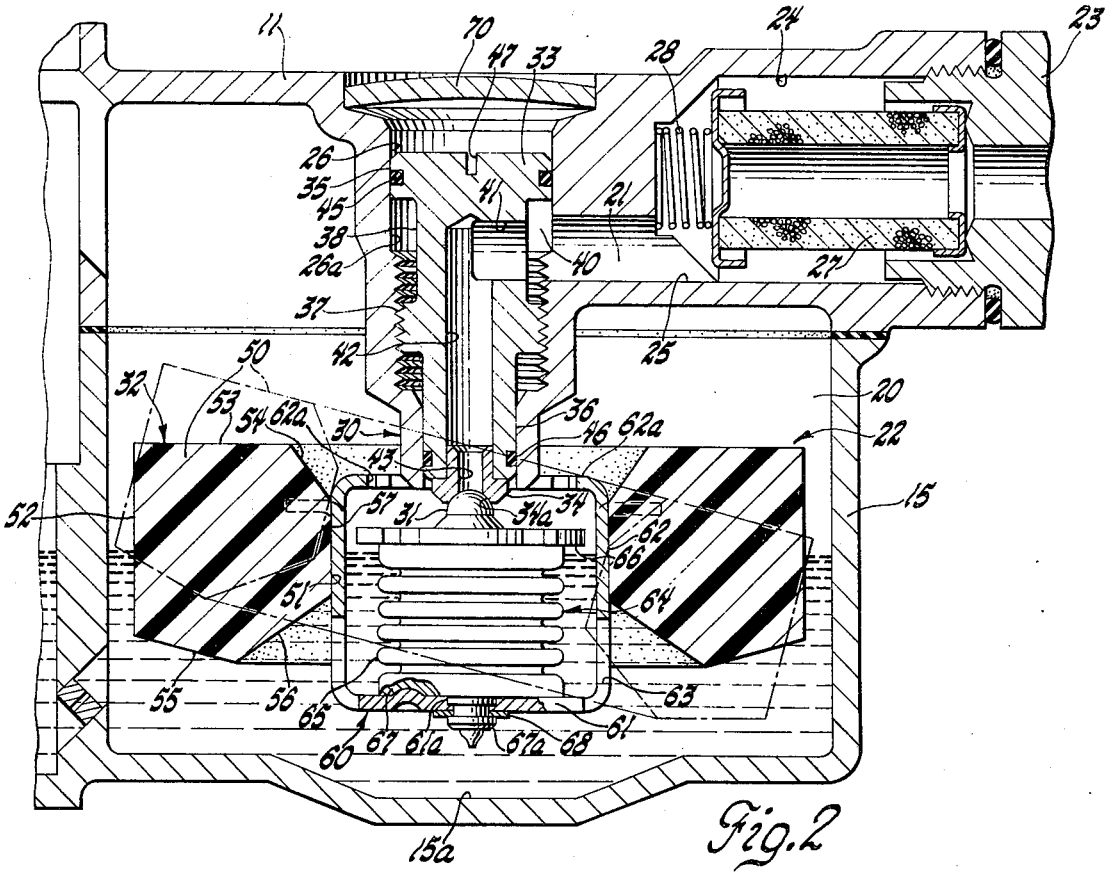

For a better understanding of the invention, as well as other objects and further features thereof, reference is had to the following detailed description of the invention to be read in connection with the accompanying drawings, wherein:

FIG. 1 is a schematic view of a portion of a venturi carburetor having a float bowl, the fuel level in which is controlled by an altitude compensated float valve unit in accordance with the invention; and, FIG. 2 is an enlarged sectional view of a portion of the carburetor of FIG. 1 showing in detail the float valve unit of the invention.

Referring now to the drawings, there is shown in FIG. 1 a carburetor, generally designated 10, for an internal combustion engine, not shown, the carburetor having an air horn portion or body 11 through which an induction passage 12 extends. The entrance of air into the induction passage 12 is controlled by the usual choke valve, not shown, and a throttle valve 14 controls the flow of induction fluids or combustible mixtures to the engine. A fuel float bowl 15 from which fuel is supplied in the usual manner to the main nozzle 16 and the idle ports 17 is suitably secured to the body 11.

As best seen in FIG. 2, the fuel float bowl 15, of box-like configuration open at the top, together with a portion of the body 11, which serves as a cover, form a fuel reservoir chamber or fuel well 20 supplied with fuel from a substantially horizontal fuel inlet passage 21 provided in the body 11 communicating in a manner to be described with the fuel well 20, with flow into the fuel well 20 being controlled by a float valve assembly, generally designated 22, in accordance with the invention. An external fuel conduit 23 connected to the inlet passage 21 supplies fuel under pressure from the main fuel tank and the fuel pump, both not shown, for the engine.

Inlet passage 21 is formed by a stepped and offset bore in the body 11 which includes an enlarged bore portion 24 extending from an end of the body 11 and a reduced diameter bore portion 25 which intersects a stepped bore 26, defining a stepped plug receiving sleeve, extending vertically through the body 11. The bore portion 24 has the usual fuel filter 27 positioned therein, biased by a spring 28 into engagement with the end of the fuel conduit 23.

Referring now to the subject matter of the invention, the float valve assembly 22 includes an inlet seat assembly 30 and an inlet valve 31, having a semi-spherical seating tip, which is an integral part of a float and aneroid assembly 32.

Inlet seat assembly 30, in the embodiment shown, includes a cylindrical plug 33 and a flanged valve seat 34. The plug 33 has upper and lower seal lands 35 and 36, respectively, and an intermediate threaded land 37, the lands 35 and 37 being connected by a necked portion 38 of reduced diameter to form with the portion **26*a* of bore 26 a fuel inlet chamber 40 in unrestricted fluid flow communication with inlet passage 21. Fuel from the inlet chamber 40 flows to the fuel well 20 via a radial slot or passage 41 in the necked portion 38 which is in communication with a vertical bored passage 42 extending from the bottom of plug 33 to intersect the passage 41 and, through the orifice 43, of a predetermined diameter, in the valve seat 34, the latter being suitably fixed to the plug as by having its reduced diameter portion slidably received in the lower end of bored passage 42 and with the radial flange portion thereof in abutment against the lower end of the plug 33**.

The lands 35 and 36 of the plug 33 are provided with annular grooves therein to receive the O-ring seals 45 and 46, respectively, to effectively seal the plug 33 within the bore 26 while still permitting axial adjustment of the plug within the bore. In addition, the upper or head end of the plug 33 is provided with a tool receiving slot 47 whereby the inlet seat assembly 30 can be adjusted vertically in the body 11 by engagement of the threaded land 37 with a complementary threaded portion of the bore 26. With this arrangement, the annular inlet valve seat **34*a* at the lower end of valve seat 34 which is concave in shape and formed complementary to the tip of valve 31 can be adjusted vertically with respect to the bottom wall 15*a* of the fuel float bowl 15** for a purpose which will become apparent.

Float and aneroid assembly 32 includes a float 50, of suitable material in toroidal configuration, with inner and outer peripheral walls 51 and 52, respectively, an upper wall 53 extending at right angle from outer wall 52 and merging with a downwardly inclined wall 54 which in turn merges with inner wall 51 and a bottom wall 55 extending at an obtuse angle from outer wall 52 to merge with an upwardly inclined wall 56 that extends to inner wall 51.

A cup-shaped aneroid retainer 60 having a base 61 and an upstanding annular rim 62 with a plurality of enlarged cut-out openings 63 therethrough, is suitably fixed to the float as by having the annular rim 62 secured in a suitable manner to the inner wall 51 of the float.

An evacuated aneroid 64, including a bellows 65 fixed at opposite ends to upper and lower bellows end plates 66 and 67, respectively, is concentrically positioned within the aneroid retainer 60 with its lower end fixed thereto as by having the axial pin 67*a* on the lower plate 67 extending through an aperture 61*a* in base 61 to receive a split retaining ring 68 secured in a suitable annular groove provided for this purpose in the pin 67*a* adjacent to its free end. With this arrangement, the upper end of the bellows is free to move axially within the retainer to axially position the inlet valve 31, suitably fixed concentrically to the upper end plate 66 of the aneroid, relative to a suitable base line, of the float and aneroid assembly 32, such as base 61, for example, of aneroid retainer 60. With this arrangement, the effective height of the inlet valve 31 relative to base 61 will vary due to changes in elevation at which the carburetor is operating or due to other barometric changes.

Movement of the upper end of the aneroid 64 in an outward direction relative to the retainer 60 is limited by a plurality of fingers 62*a*, extending from the free end of the rim 62, that are bent radially inward to be in interference relationship to the path of movement of the upper bellows plate 66, adjacent to the outer peripheral edge of this plate, to thereby prevent complete shut-off of inlet fuel by limiting movement of this end of the aneroid in the event that the bellows 65 thereof is ruptured in any way.

As previously described, fuel from the fuel pump, not shown, enters through the fuel inlet passage 21 and is discharged into the float bowl through the orifice 43 in the inlet valve seat 34. As the level of fuel in the float bowl rises, the bouyant action of the float 50 raises the float and aneroid assembly 32 to effect seating of the inlet valve 31 in the valve seat 34*a* to shut-off the flow of fuel into the float bowl.

The float 50 of the float and aneroid assembly 32 is of a desired size to exert sufficient force on the inlet valve 31 to seat it against the valve seat 34 against the pressure of inlet fuel to shut-off fuel flow when a predetermined level is reached.

The fuel level height at which this fuel shut-off occurs will depend on the ambient atmospheric pressure and, of course, will vary with changes in the altitude or elevation at which the carburetor is functioning, since the effective height of the inlet valve 31 relative to a base line on the float and aneroid assembly 32 will vary. That is, since the aneroid is evacuated with one end fixed to the base 61 of the aneroid retainer, the effective height of the aneroid, that is, of the free end thereof carrying the valve 31 increases as ambient pressure decreases due to increases in elevation or other barometric changes, so that shut-off of the fuel inlet will occur at a lower fuel level in the float bowl than would occur at lower elevations.

The semi-spherical configuration of inlet valve 31 and the shape of the float 50 allows for variation in angularity of the carburetor during operation. Thus, when the carburetor is in a horizontal or level position, the float 50 would be in the solid line position shown in FIG. 2, whereas when the carburetor is inclined at an angle to the horizontal, the float 50 can assume the position shown in broken lines in FIG. 2 with the inlet valve 31 pivoting relative to the valve seat 34 to, in effect, maintain alignment of the float and aneroid assembly 32 relative to the valve seat 34.

Initial seating of the fuel level within the float bowl is effected during calibration of the carburetor through the vertical adjustment of the inlet seat assembly 30 by means of the threaded engagement of the inlet seat assembly 30 within the body 11 as by inserting a suitable tool, such as a screw driver, in the slot of the inlet seat assembly 30. After vertical positioning of the cylindrical plug 33 and therefore valve seat 34 is effected, a plug 70 is assembled into the enlarged end portion of bore 26 and the body 11.

It will be apparent from the above description that in use on a vehicle, the aneroid 64, carrying the valve 31, as fixed to the float 50 will respond to any change in barometric pressure due to changes in altitude or other atmospheric conditions to maintain the proper fuel level for those conditions within the float bowl. At altitude, a lower fuel level is required in the float bowl to prevent an over-rich air/fuel mixture from being supplied to the engine.

It will be apparent to those skilled in the art that the subject altitude compensated carburetor float valve unit of the invention can be used in conjunction with any carburetor venturi metering system which is dependent on the height of the fuel level in its calibration.

What is claimed is:

1. In a carburetor having body means arranged to provide a fuel reservoir chamber, a vertical bore through said body means opening into said chamber, a substantially horizontal inlet passage in said body means extending to said vertical bore, a cylindrical inlet seat member adjustably secured in said vertical bore in sealed relation thereto, passage means in said inlet seat member in communication with said vertical bore and said inlet passage, said passage means including a tubular valve seat member having an annular valve seat open to said fuel reservoir chamber and, a float aneroid assembly positioned in said fuel reservoir chamber, said float aneroid assembly including a float of toroidal configuration and an aneroid mounted concentrically therein with one end of said aneroid fixed relative to said float and with its opposite end free for axial movement relative to said float and a semi-spherical valve fixed to said opposite end of said aneroid in position to co-act with said valve seat to control flow of fuel into said fuel reservoir chamber.

2. In a carburetor having body means providing a fuel reservoir chamber therein, a vertical bore through said body means opening into said chamber, said bore providing annular wall means including an intermediate internal threaded wall portion, an inlet passage in said body means extending to said vertical bore, a cylindrical inlet seat member adjustably secured in said vertical bore in sealed relation thereto, said cylindrical inlet seat member having axially spaced apart external lands thereon of an outside diameter corresponding to the internal diameter of said vertical bore with a reduced diameter annular neck portion between said lands defining with said annular wall means a fluid chamber in communication with said inlet passage, passage means in said inlet seat member, said passage means including a radial passage in communication with said fluid chamber and a vertical passage extending from the lower end of said inlet seat member concentrically therewith to intersect with said radial passage, said vertical passage terminating at the lower end of said inlet seat member in an annular valve seat, a toroidal float positioned in said fuel reservoir chamber, a cup-shaped aneroid retainer concentrically supported in said toroidal float, a bellows type aneroid fixed at one end to said aneroid retainer with the opposite end free to move relative to said aneroid retainer and a semi-spherical valve secured to said opposite end of said aneroid in position to co-act with said valve seat to control the flow of fuel from said vertical passage into said fuel reservoir chamber.

3. In a carburetor having wall means defining a fuel chamber, said wall means including an upper wall having a stepped, partly threaded, substantially vertical bore therethrough opening into said fuel chamber and a fuel inlet passage intersecting said bore, a valve in said fuel chamber, a cylindrical valve seat member adjustably threaded in said bore in fluid sealed relation therein, said valve seat member having a valve seat at its lower end of said valve seat member to socketably receive said valve, an axial inlet bore extending from said lower end, a passage means providing communication between said inlet bore and said fuel inlet passage, and a float and aneroid means movably positioned in said fuel chamber concentric with said valve seat member, said float and aneroid means including a ring shaped float and an aneroid concentrically mounted at one end to said float with its opposite end free to move relative to said float, said valve being fixed to said opposite end of said aneroid.

* * * * *